US010121616B2

(12) United States Patent
Zhou et al.

(10) Patent No.: US 10,121,616 B2
(45) Date of Patent: Nov. 6, 2018

(54) WINDOW SWITCH ASSEMBLY OF A VEHICLE

(71) Applicant: FORD GLOBAL TECHNOLOGIES, LLC, Dearborn, MI (US)

(72) Inventors: Jason Zhou, Nanjing (CN); Layla Mi, Nanjing (CN); Tina Li, Nanjing (CN); Fiona Yang, Nanjing (CN)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/702,559

(22) Filed: Sep. 12, 2017

(65) Prior Publication Data

US 2018/0082811 A1 Mar. 22, 2018

(30) Foreign Application Priority Data

Sep. 20, 2016 (CN) ..... 2016 1 0835774

(51) Int. Cl.
*H01H 25/00* (2006.01)

(52) U.S. Cl.
CPC ..... *H01H 25/002* (2013.01); *E05Y 2400/854* (2013.01); *E05Y 2400/86* (2013.01); *E05Y 2900/55* (2013.01); *H01H 2300/01* (2013.01)

(58) Field of Classification Search
CPC .. H01H 2300/01; H01H 25/00; H01H 25/008; H01H 25/002; E05Y 2400/854; E05Y 2400/86; E05Y 2900/50
See application file for complete search history.

(56) References Cited

U.S. PATENT DOCUMENTS

| | | | | |
|---|---|---|---|---|
| 4,795,862 | A | 1/1989 | Linden | |
| 4,808,775 | A * | 2/1989 | Satoh | H01H 1/18 200/1 V |
| 5,598,918 | A | 2/1997 | Malecke et al. | |
| 7,021,001 | B1 | 4/2006 | Schooler | |
| 7,439,460 | B1 * | 10/2008 | Watson | B60R 16/005 200/18 |
| 8,134,312 | B2 | 3/2012 | Kigoshi | |

FOREIGN PATENT DOCUMENTS

| | | |
|---|---|---|
| CN | 103219188 A | 7/2013 |
| CN | 103928242 B | 9/2015 |

* cited by examiner

*Primary Examiner* — Vanessa Girardi
(74) *Attorney, Agent, or Firm* — Vichit Chea; Mohr IP Law Solutions, PC

(57) ABSTRACT

A window switch assembly of a vehicle comprises a base; a rail on the base; and a control member partially received in the rail and slidable in the rail. The rail includes a first rail body extending at a traverse direction, a first end portion and a second end portion communicated with the first rail body. The first end portion includes a first switch and a second switch opposite each other in a longitudinal direction, and the second end portion includes a third switch and a fourth switch opposite each other in the longitudinal direction. The control member selectively contacts the first switch and the second switch to control a first window, and selectively contacts the third switch and the fourth switch to control a second window.

19 Claims, 5 Drawing Sheets

WINDOW SWITCH ASSEMBLY OF A VEHICLE

RELATED APPLICATION

This application claims the benefit of Chinese Patent Application No.: CN 201610835774.5 filed on Sep. 20, 2016, the entire contents thereof being incorporated herein by reference.

FIELD

The present application relates to a window switch assembly of a vehicle, particularly, relates to a window switch assembly to control multiple windows intuitively.

BACKGROUND

It is common to provide a window switch system having multiple switches for a driver to open and close multiple windows. As the switches are disposed in proximity, it can be difficult for the driver to quickly locate a proper switch for a widow.

The U.S. Pat. No. 7,439,460 B1 discloses a window switch system which uses a first switch to select a window and a second switch integrated with a first window to selectively open or close the window. However, the window switch system is complicated in its structure and not convenient in operation. Further, after the use, the switch is always remained in a last operation position. Therefore, the driver still needs to look at the switch location before selecting a switch. Therefore, it is desirable to provide a window switch system for the driver to control multiple windows which is simple in operation. Further, it is desirable to provide a window switch system for a driver to control multiple windows intuitively without the need to moving his or her sight away from the front of the vehicle.

SUMMARY

According to one aspect, a window switch assembly of a vehicle is provided. The window switch assembly comprises a base; a rail on the base, and a control member partially received in the rail and slidable in the rail. The rail includes a first rail body extending at a traverse direction, a first end portion and a second end portion communicated with the first rail body. The first end portion includes a first switch and a second switch opposite each other in a longitudinal direction, and the second end portion includes a third switch and a fourth switch opposite each other in the longitudinal direction. The control member selectively contacts the first switch and the second switch to control a first window, and selectively contacts the third switch and the fourth switch to control a second window.

In one embodiment, the window switch assembly further comprises a second rail extending at the traverse direction, and a middle rail extending along the longitudinal direction and communicating with the first rail body and the second rail body. The second rail includes a second rail body, a third end portion and a fourth end, portion communicated with the second rail body. The third end portion includes a fifth switch and a sixth switch opposite each other at the longitudinal direction and the fourth end portion includes a seventh switch and an eighth switch opposite each other at the longitudinal direction. The control member selectively contacts the fifth switch and the sixth switch to control a third window, and selectively contacts the seventh switch and the eighth switch to control a fourth window.

In another embodiment, the window switch assembly further comprises a resilient member coupling the control member with the rail body. The resilient member is configured to bias the control member toward a rest position.

In another embodiment, the window switch assembly further comprises a resilient member coupling the control member with the middle rail. The resilient member is configured to bias the control member toward a rest position.

In another embodiment, the resilient member is an electric conductive spring, the first switch is a first contact electrically connected to a window control circuit. The control member includes a first contacting point matching the first contact, and wherein the first contact of the control member is electrically connected to the spring which is in turn connected to the window control circuit.

In another embodiment, the first end portion is configured to be a first sub-rail extending along the longitudinal direction, the first switch and the second switch are disposed on two ends of the first sub-rail, respectively; and the second end portion is configured to be a second sub-rail extending along the longitudinal direction, the third switch and the fourth switch are disposed on two ends of the second sub-rail, respectively.

In another embodiment, the first switch is a micro switch.

In another embodiment, the first switch is a switch to roll up a first front window, and the second switch is a switch to roll down the first front window.

In another embodiment, a sidewall of the control member includes a recess, and a sidewall of the first rail includes a sliding block to be received in the recess to guide movement of the control member the first rail.

According to another aspect, the window switch assembly to control multiple windows of a vehicle is provided. The window switch assembly comprises a base including a first rail, a second rail, a middle rail extending along the second direction; a plurality of switches and a control member. The first rail includes a rail body extending along a first direction, and a first sub-rail and a second sub-rail extending from two ends of the first rail body along a second direction, respectively, and the second direction is different from the first direction. The second rail includes a second rail body extending along the first direction, and a third sub-rail and a fourth sub-rail extending from two ends of the second rail body along the second direction, respectively. The middle rail is configured to extend along the second direction and communicating with the first rail body and the second rail body. The plurality of switches includes a right front window rolling-up switch and a right front window rolling-down switch disposed at the two ends of the first sub-rail, respectively; a left front window rolling-up switch and a left front window rolling-down switch disposed at the two ends of the second sub-rail, respectively; a right rear window rolling-up switch and a right rear window rolling-down switch disposed at the two ends of the third sub-rail, respectively; and a left rear window rolling-down switch and a left rear window rolling-down switch disposed at the two ends of the fourth sub-rail, respectively. The control member is received partially in the middle rail at a rest position and is slidable in the first, second, third and fourth sub-rails and the middle rail to contact the window switches assembly selectively.

In one embodiment, the window switch assembly further comprises a spring. One end of the spring is connected to middle rail and another end of the spring is connected to the control member and wherein the spring applies a restoring force to bias the control member to the middle rail.

In another embodiment, the switch member is a power switch. The control member contacts one of the plurality of switches in a shorter period to rolling up or roll down a corresponding window for a certain distance, and the control rod contacts one of the switches for a longer period to close or open a corresponding window fully.

In another embodiment, the control member includes a control rod. Each switch is a contact disposed on a sidewall of the sub-rails and electrially connected to a window control circuit. A surface of the control rod adjacent to a sliding end includes a conflicting point latching the contact. The contacting point is electrically connected to the spring which is connected to the window control circuit. The control rod touches the switch to enable a connection with the window control circuit.

In another embodiment, the control member includes a control rod. Each switch is a contact disposed on a bottom of the sub-rails and electrially connected to a window control circuit, and a sliding end of the control rod includes a contacting point matching the contact. The contacting point is electrically connected to the spring which is electrically connected to the window control circuit. The control rod touches the switch to enable a connection with the window control circuit.

In another embodiment, the window switch assembly is disposed on a side of a front door adjacent to a driver.

In another embodiment, the window switch assembly is disposed on an instrument panel adjacent to a driver.

In another embodiment, a side surface of the control member includes a first recess, a sidewall of the first, second and middle rails includes a first sliding block to be received in the recess to guide the control member to move in the first, second and middle rails.

In another embodiment, a bottom wall of the control member includes a second sliding block, wherein a bottom wail of the first, second, and middle rails include a second recess to receive the second sliding block to guide movement of the control member in the first, second and middle rails.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

One or more advantageous features as described herein will be readily apparent from the following detailed description of one or more embodiments when taken in connection with the accompanying drawings.

BRIEF DESCRIPTION OF THE DRAWINGS

For more complete understanding of one or more embodiments of the present invention, reference is now made to the one or more embodiments illustrated in greater detail in the accompanying drawings and described below.

It should be noted that these figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION

The disclosed window switch assemblies of a vehicle will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various window switch assemblies are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
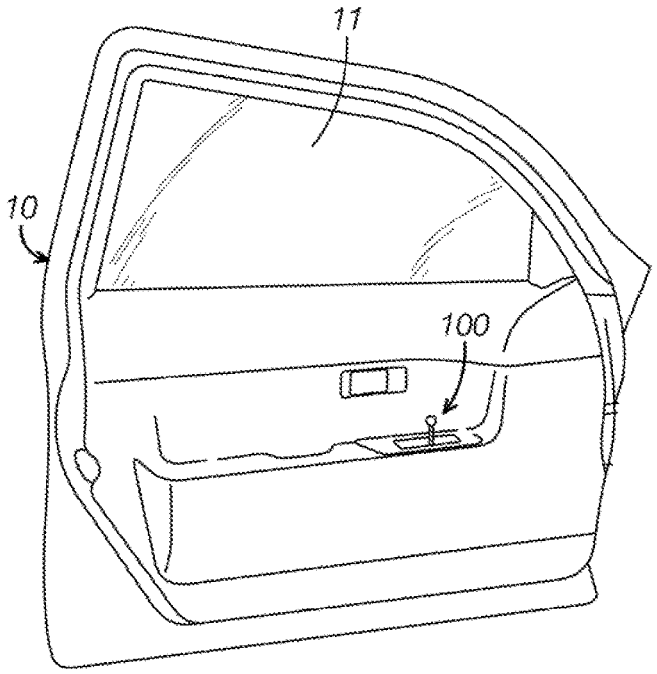
FIG. 1 is a schematic diagram of a vehicle window in which a window switch system of the present disclosure can be implemented

FIG. 1 schematically illustrate a window 11 in which a window switch assembly 100 according to one embodiment of the present disclosure may be implemented. In the depicted embodiment, the window 11 is a left window adjacent to a driver. A vehicle may have multiple windows. For example, a two-door vehicle may include multiple windows, such as a left front window 11, and a right front window (not shown). A four-door vehicle may include a front left window 11, a front right window, a rear left window, and a rear right window. For illustration purpose, the window switch assembly 100 is positioned on the door 10 at a driver side. In other embodiments, the window switch assembly 100 may be disposed at other positions, such as vehicle control panel at a driver side, a floor console, an overhead console. Similarly, the window switch assembly may be positioned at a door of a passenger side, a seat control panel or other locations convenient for a passenger to control the windows.

Figure 2A:
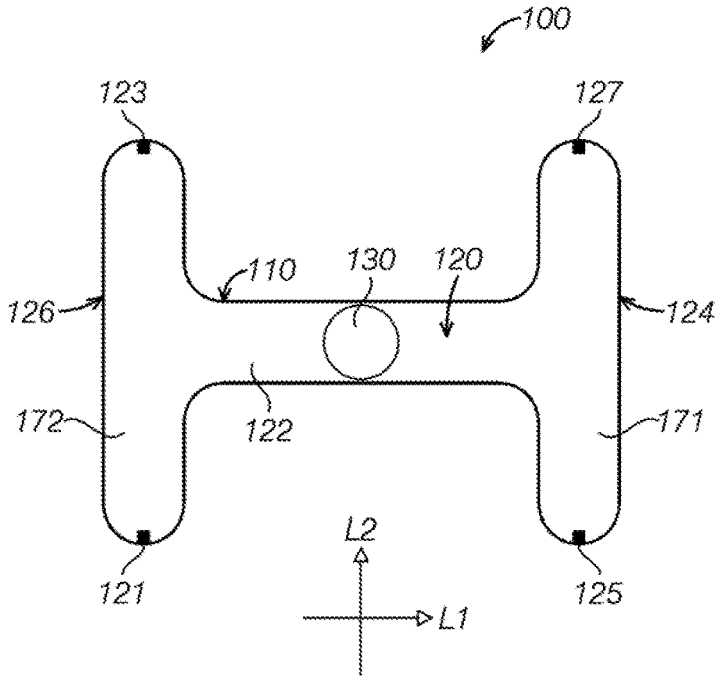
FIG. 2A is a plan view of a window switch assembly of a vehicle according to one embodiment of the present disclosure, illustrating a control member at a rest position.
Figure 2B:
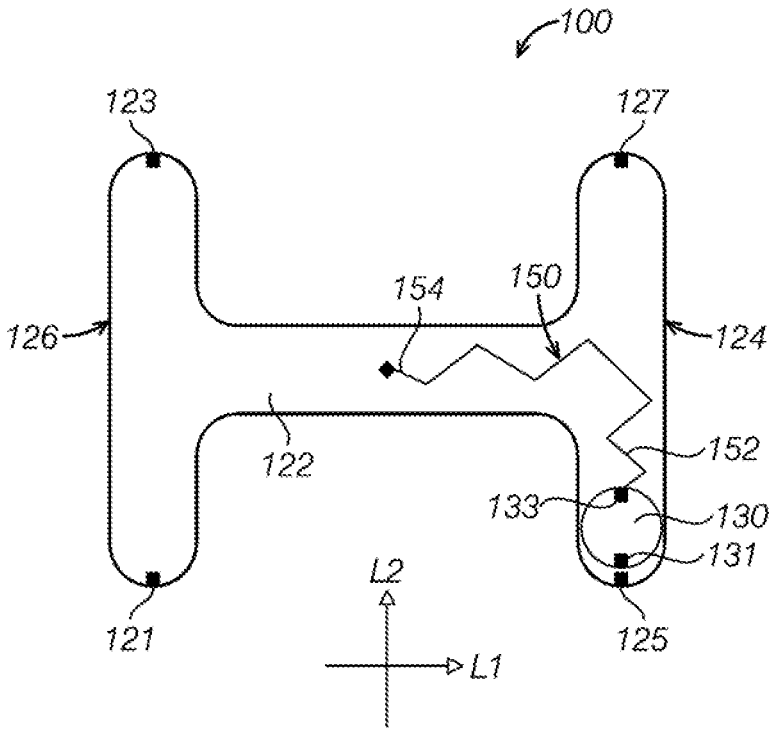
FIG. 2B is a plan view of the window switch assembly in FIG. 2A, illustrating the control member at a position of a first switch.

Referring to FIG. 2A to 2B, FIGS. 2A-2B illustrate a window switch assembly 100 disposed on a left from window of a vehicle according to one embodiment of the present disclosure. The window switch assembly 100 includes a base 110, a rail 120 in the base 110, and a control member 130. The rail 120 includes a first rail body 122 extending at a traverse direction L1, a first end portion 124 and a second end portion 126 communicated with the first rail body 122. In depicted embodiment as viewed by a driver, the first end portion 124 is at a right side relative to the second end portion 126. The first end portion 124 includes a first switch 125 and a second switch 127 opposite each other in a longitudinal direction L2, and the second end portion 126 includes a third switch 121 and a fourth switch 123 opposite each other in the longitudinal direction L2. The control member 130 is partially received in the rail 120, slidable in the rail 120, and selectively contacts the first switch 125 and the second switch 127 via an operation by a user to control opening and closing of a first window or a right window, respectively, and selectively contacts the third switch 121 and the fourth switch 123 via an operation by a user to control opening and closing of a second window or a left window, respectively.

In some embodiments, the window switch assembly 100 shown in FIG. 2A control two windows in the vehicle, for example, a left window and a right window of a two-door vehicle, or a left front window and a right front window of a four-door vehicle. It should be understood that first window and/or the second window may also include two or more windows. For example, the first window also includes a right front window and a right rear window of vehicle. When the control member 130 contacts the first switch 125, the right front window and the right rear window are opened simultaneously. When the control member 130 contacts the second switch 127, the right front window and the right rear window are closed simultaneously. Similarly, the second window also includes a left front window and a left rear window of the vehicle, the control member 130 contacts the third switch 121 or forth switch 123 to control opening or closing of the left front window and the left rear window simultaneously. In this way, the window switch assembly 100 in FIG. 2A also can apply to a vehicle having multiple windows.

Referring to FIG. 2A, the first end portion 124 of the rail 120 is formed to be a first sub-rail 171 extending along the longitudinal direction L2. The first switch 125 and the second switch 127 are disposed on two ends of the first sub-rail 171, respectively. For example, the first switch 125 may be disposed on a back end of first sub-rail and drives the first window up via contact with the control member 130 and the second switch 127 may be disposed on the front end of the first sub-rail 171 to drive the first window down. Similarly, the second end portion 126 of the rail 120 is formed to be a second sub-rail 172 extending along the longitudinal direction L2. The third switch 121 and the fourth switch 123 are disposed on two ends of the second sub-rail 172, respectively. For example, the third switch 121 is disposed on a back end of the second sub-rail 172 to drive the second window up, and the fourth switch 123 is disposed on a front end of the second sub-rail 172 to drive the second window down. Although the figure shows that traverse direction L1 is perpendicular to longitudinal direction L2, they may also be in any angles, such as 45, 60, or 75 degrees.

Alternatively, the first end 124 of the rail 120 may not be formed as the first sub-rail 171. Instead, the first and second switches 125 and 127 may be disposed on two opposite side walls along longitudinal direction L2 to roll the window up or down. The second end portion 126 may be configured to have a similar structure.

Figure 3:
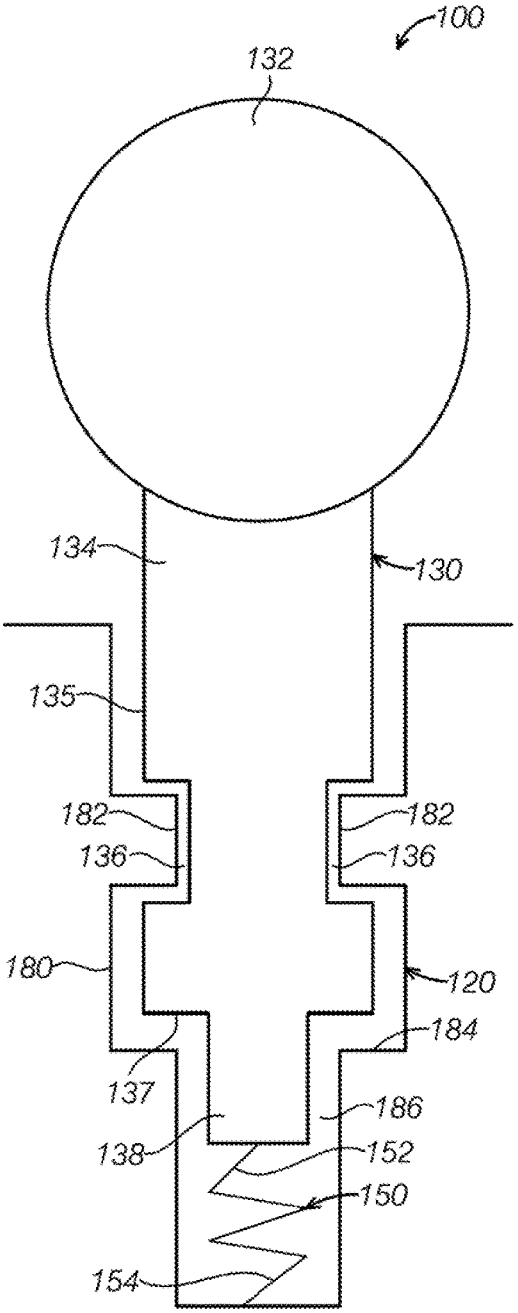
FIG. 3 schematically illustrates a cross-sectional view of a partial rail and a control member according to one embodiment of the present disclosure.

FIG. 3 schematically illustrates a partial cross-sectional view of a rail and a control member according one embodiment of the present disclosure. In one embodiment, the control member 130 may include a control rod 134 and a control head 132. The control rod 134 is partially received in a first rail 120. The sidewall 135 of the control member 110 or the control rod 134 may include a recess 136. The side wall 180 of the first rail 120 may include a sliding block 182. The first sliding block 182 is received in the first recess 136 and slidable to guide the control member 130 to slide in the first rail 120 along the traverse direction L1. Such configuration enables the control member 130 to slide in the first rail 120 smoothly without being tilted. For clarity and brevity, FIG. 3 illustrates two sets of the first sliding block 182 and first recess 136, it should be appreciated that one set or more than two sets of the first sliding block and/or first recess can be provided to assist the movement of the control member 130. Alternatively, the first sliding block 182 may be disposed on a side wall 135 of the control rod 134, and the first recess 136 may be disposed on the sidewall 180 of the first rail 120.

Additionally, a bottom wall 137 of the control member 130 or the control rod 134 may include a second sliding block 138. A bottom wall 184 of the first rail 120 may include a second recess 186. The second sliding block 138 slides in the second rail 186 to guide the movement of the control member 130. Similarly, in other embodiments, the second recess may be disposed on the bottom wall 137 of the control rod 134, and the second sliding block may also be disposed on the bottom wall 184 of the first rail 120.

The control switch assembly 100 further includes a resilient member 150. For illustration purpose, the resilient member 150 is shown as a spring in the depicted embodiment. It should be appreciated, other forms of the resilient member are possible such as an elastic rubber, a rubber band. The resilient member 150 is disposed between the control member 130 and the first rail body 122 and couples the control member 130 to the first rail body 122. In an embodiment shown in FIG. 3, one end 152 of the resilient member 150 is connected to the second sliding block 138 of the control rod 134, and another end 154 is connected to the second recess 186 of the first rail 120 to apply a bias force on the control member 130 toward the rest position as shown in FIG. 2A.

When the window switch assembly 100 is not in use, the control member 130 is at rest position as shown in FIG. 2. As illustrated in FIG. 2B, when a user operates the control member 130 to move to the first switch at the first end portion 124, the resilient member 150 biases the control member 130 to the first rail body 122. Thus, when the user releases his or her hand from the control member 130, the control member 130 returns to the rest position by the resilience force. Thus, the control member 130 is always at the rest position whenever the user wants to roll the window up and down. In one example, the movement of the control member 130 toward left may activate opening or closing of the left window, and a movement toward right may activate opening or closing of the right window. Therefore, the user can perform a desired operation without looking at the switch.

It should be understood that the rest position is located at a middle position of the first rail body 122 as illustrated in the figures, however, it can be at any other positions, such as closer to the first end portion 124 or second end portion 126.

Continuing with FIG. 2B, in one embodiment, the first switch 125 may be a first contact 125 connected to a first window control circuit, and the resilient member 150 is an electric, conductive spring. Correspondingly, the control n ember 130 includes a first contacting point 131 matching the first contact 125, and the first contact point 131 is electrically connected to the electric conductive spring 150.

With further reference to FIG. 3, the electric conductive spring 150 is further electrically connected to the first window control circuit via its end 154. Thus, when the control member 130 is at the first switch position as shown in FIG. 2B, the user can further apply a force of the control member 130 for the first contact 125 to contact the first contacting point 131 and connect the circuit such that the first window control circuit is activated to drive the first window up. Similarly, the second switch 127 may be a second contact 127 electrically connected to a second window control circuit, and the control member 130 includes a second contacting point 133 matching the second contact 127. When the second contact 127 contacts the second contacting point 133 of the control member 130, the second window control circuit is activated to drive the first window down. Similarly, the first contacting point 131 can contact the third switch 121 or a third contact to drive the second window up, and the second contacting point 133 can contact the fourth switch 123 or a fourth contact to drive the window down.

The first switch 125 may be a micro switch. Thus, when the control member 130 rests on the first switch 125, the first window control circuit is activated to drive the first window up. Similarly, the second, third and/or fourth switch may be micro switches. Such configuration is simple without a need for a complicate circuit.

Alternatively, the first, second, third, and/or fourth switch may be an electric switch. Thus, a short time contact between the control member 130 and one of these switches can drive corresponding window up or down to a certain distance while a longer time contact between the control member 130 and one of these switches can close or open these windows fully.

Figure 4:
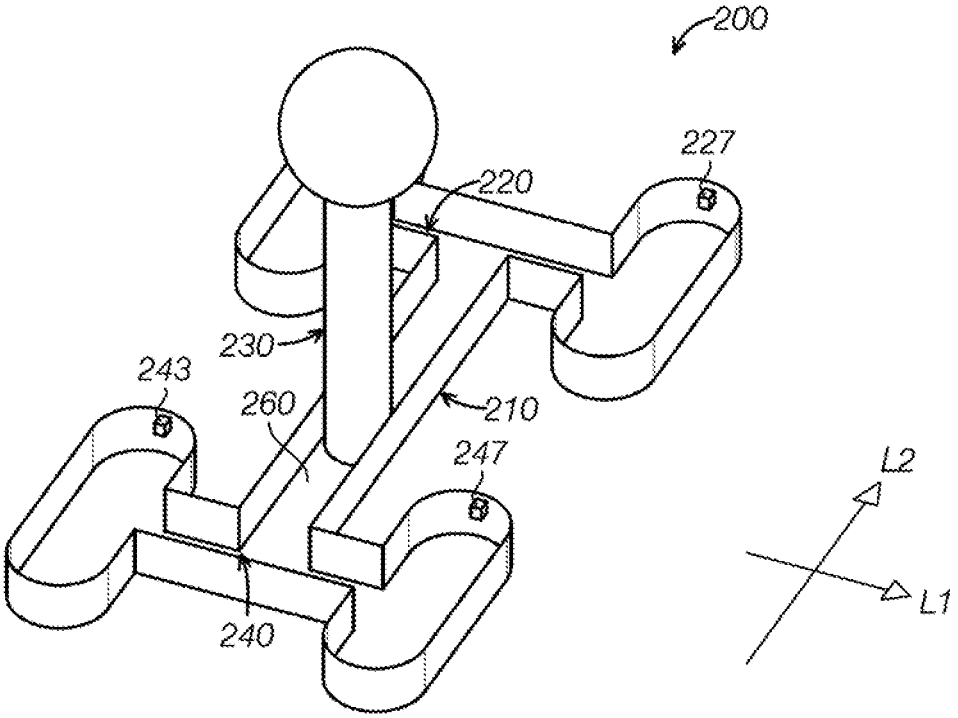
FIG. 4 schematically illustrates a perspective view of a window switch assembly according to another embodiment of the present disclosure.
Figure 5A:
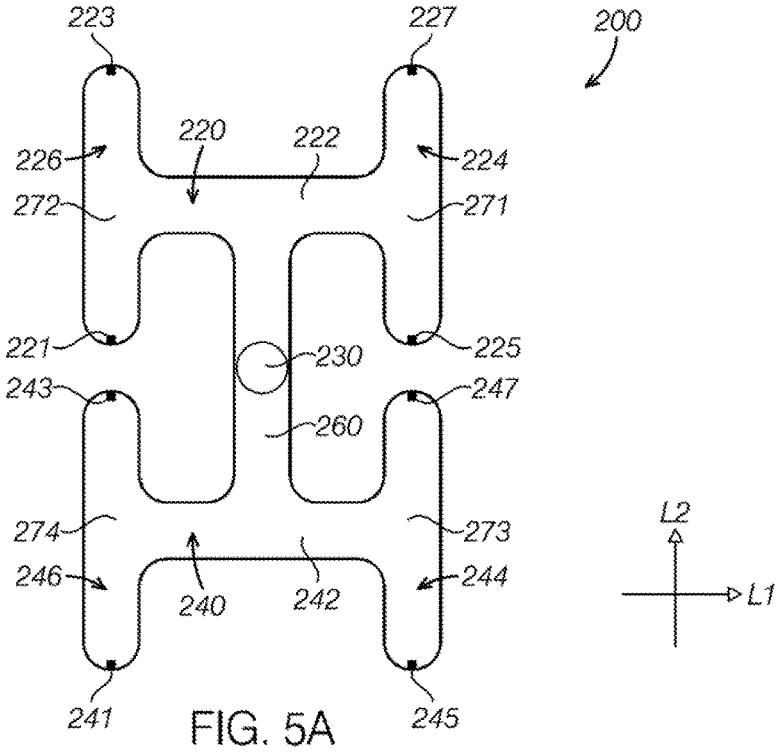
FIG. 5A schematically shows a top view of a window switch assembly in FIG. 4, illustrating the control member at a rest position.
Figure 5B:
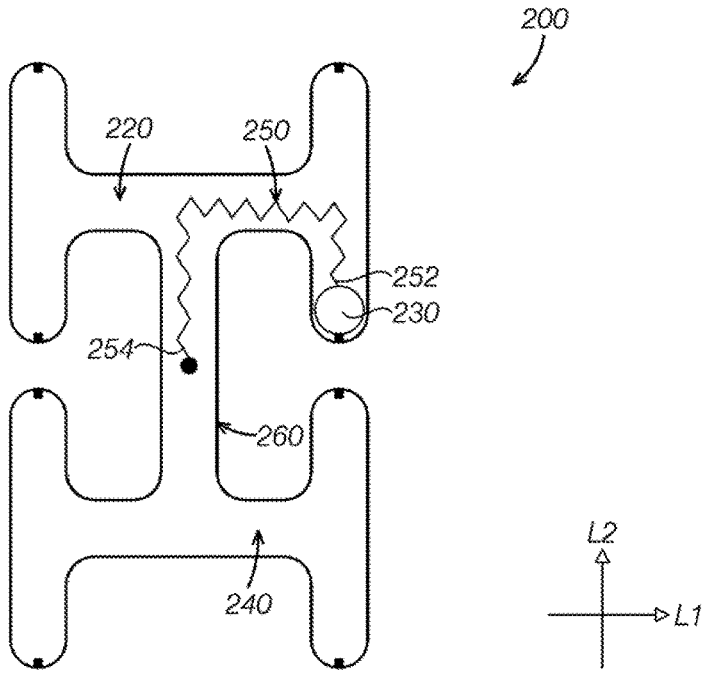
FIG. 5B schematically shows a top view of the window switch assembly in FIG. 4, illustrating the control member at a first position of a first window.

Referring to FIGS. 4 to 5B, a window switch assembly 200 according to another embodiment of the present disclosure is illustrated. The window switch assembly 200 comprises a first rail 220, a second rail 240 and a middle rail 260. The first rail 220 and the second rail 240 extend along a traverse direction L1. The middle rail 260 extends along longitudinal L2 and communicates with a first rail body 222 and a second rail body 242. The first rail 220 includes the first rail body 222 extending along the traverse L1, and the first end portion 224 and the second end portion 226 which are communicating with the first rail body 222. The second rail 240 includes the second rail body 242 extending along the traverse L1, and the third end portion 244 and the fourth end portion 246 which are communicating with the second rail body 242.

The window switch assembly 200 may further include a plurality of window switches. For example, the window switch assembly 200 may include a first switch 225 and a second switch 227 opposite the first switch 225 at the longitudinal direction L which are disposed on the first end portion 224, respectively; and the third switch 221 and the fourth switch 223 opposite each other at longitudinal direction which are disposed on the second end portion 226. The window switch assembly 200 may further include the fifth switch 245 and the second switch 247 opposite each other at the longitudinal direction L2 which are disposed on the third end portion 244, and the seventh switch 241 and the eighth switch 243 opposite each other at the longitudinal direction L2 which are disposed on the fourth end portion 246.

The control member 230 selectively contacts the first switch 225 and the second switch 227 to control the opening and closing of the first window. For example, the contact of the control member 230 with the first switch 225 rolls up the first window, and the contact of the control member 230 with the second switch 227 rolls down the first window. The control member 230 selectively contacts the third switch 221 and the fourth switch 223 to control the second window. For example, the contact of the control member 230 with the third switch 221 rolls up the second window, and the contact of the control member with the fourth switch 223 rolls down the second window. The control member 230 selectively contacts the fifth switch 245 and the sixth switch 247 to control the third window. For example, the contact of the control member 230 with the fifth switch 245 rolls up the third window, and the contact of the control member 230 with the sixth switch 247 rolls down the third window. The control member 230 selectively contacts the seventh switch 241 and the eighth switch 243 to control the fourth window. For example, the contact of the control member 230 with the seventh switch 241 rolls up the third window up, and the contact of the control member 230 with the eighth switch 243 rolls down the fourth window down.

The control member 230, the first rail 220, the second rail 240, and the middle rail 260 may include recesses or sliding blocks to guide the movement of the control member in the first, second, and middle rails 220, 240, 260. These recesses and sliding blocks may be similar to those in the window switch assembly 100. A user can slide the control member 230 in the rails to make it contact the switches to activate the switch circuit. In some embodiments, the longer the time the control member 230 contacts the window switch, the longer distance the window rolls up or down. In some embodiments, the window switch is an electric switch. A short contact time of the control member with the window switch rolls corresponding window up or down in a certain distance. A long contact time of the control member with the window switch will automatically open or close the window completely.

Referring to FIG. 5B, the resilient member 250 couples the control member 230 to the middle rail 260. For example, one end 254 of the resilient member is connected to the middle rail 260, and another end 252 is connected to the control member 230. The bias force of the resilient member 250 imposes a restoring force to bias the control member 230 toward to the middle rail 260 to the position as shown in FIG. 5A. When the user releases the control member 230, the control member 230 returns to the rest position by the restoring force and the window stops moving.

In one embodiment, the first rail 220 includes a first rail body 222 extending along a first direction L1, and a first sub-rail 271 and a second sub-rail 272 extending from two ends of the first rail body 222 along a second direction L2, respectively, and the second direction L2 is different from the first direction L1. The first switch 225 and the second switch 227 may be a right front window rolling-up switch and a right front window rolling-down switch, respectively, which are disposed at the two ends of the first sub-rail 272, respectively. The third switch 221 and the fourth switch 223 may be a left front window rolling-up switch and a left front window rolling-down switch, which are disposed at the two ends of the second sub-rail 272, respectively.

The second rail 240 may include the second rail body 242 extending along the first direction L1, and a third sub-rail 273 and a fourth sub-rail 274 extending from two ends of the second rail body 242 along the second direction L2, respectively. The fifth switch 245 and the sixth switch 247 may be a right rear window rolling-up switch and a right rear window rolling-down switch, respectively, which are disposed at the two ends of the third sub-rail 273. The seventh switch 241 and the eighth switch 243 may be a left rear window rolling-up switch and a left rear window rolling-down switches, respectively, which are disposed at the two ends of the fourth sub rail 274, respectively.

In some embodiments, as shown in FIG. 4, each window switch is disposed on a sidewall at an end of the sub-rail and is a contact electrically connected to a window control circuit. The resilient member 250 is an electric conductive spring, and control member 230 is a control rod. The control rod 230 includes a contacting point on a side surface adjacent to a. sliding end and the contacting point corresponds to the contact on the sub-rail. In some embodiments, the control rod includes an electrical conductive ring at the side surface adjacent to the sliding end which matching the contact. The contacting point or the electric conductive ring is connected to the spring. The spring is further electrically connected to the window control circuit. The contact of the control rod with one of the switches makes the contact touch the contacting point or the electrical conductive ring of the control rod to be connect to the window control circuit. Thus, the user can move the control rod to the front end and the back end of the sub-rail to connect corresponding window control circuit to open or close the window.

In other embodiments, the window switch may be disposed on a bottom wall of the sub-rail end and is a contact electrically connected to the window control circuit. A sliding end of the control rod includes a contacting point matching the contact. In some embodiments, an electric conductive sheet matching the first contact may be disposed on a bottom wall surface of the control rod. The contact or the electric conductive sheet is connected to the electric spring which is further electrically connected the window control circuit. The contact of the control rod with the window switch makes the contacting point or the electric conductive sheet touch the contact to be communicated with the window control circuit electrically. Therefore, the user can push the control rod to the front end and the back end of the sub-rail to be connected to the corresponding window control circuit to open or close the window.

The window switch may be a micro switch, an electric switch, a contact-contacting point connection switch, or other forms.

In some embodiments, the window switch control assembly includes a control member and a plurality control positions corresponding to multiple window positions (e.g., an end portion of a rail or a sub-rail). Each control position includes two switches for opening and closing, respectively. Because the control position corresponds to the window position, a user can move the control member intuitively to a desired control position. Further, the movement of the control member forward or backward controls the rolling-up and the rolling-down of the window, respectively. Thus, the window switch control assembly enables a driver to control the opening, and closing of multiple windows accurately without the need to move his or her sight away from a front of the vehicle.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the an pertaining to such inventions.

The following claims particularly point out certain combinations and subcombinations regarded as novel and non-obvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

The invention claimed is:

1. A window switch assembly of a vehicle, comprising:
- a base;
- a rail on the base, including:
  - a first rail body extending at a traverse direction of the vehicle,
  - a first sub-rail communicating with the first rail body, extending from the first rail body along a longitudinal direction of the vehicle and having two ends spaced apart from the first rail body at the longitudinal direction,
  - a second sub-rail communicating with the first rail body, extending from the first rail body along the longitudinal direction and having two ends spaced apart from the first rail body at the longitudinal direction;
- a first switch and a second switch disposed at the two ends of the first sub-rail, respectively;
- a third switch and a fourth switch disposed at the two ends of the second sub-rail, respectively; and
- a control member partially received in the rail and slidable in the rail, wherein the control member selectively contacts the first switch and the second switch to control a first window, and selectively contacts the third switch and the fourth switch to control a second window.

2. The window switch assembly of claim 1, wherein the first switch is a micro switch.

3. The window switch assembly of claim 1, wherein the first switch is a switch to roll up a first front window, and the second switch is a switch to roll down the first front window.

4. The window switch assembly of claim 1, wherein a sidewall of the control member includes a recess, and a sidewall of the first rail includes a sliding block to be received in the recess to guide movement of the control member in the rail.

5. The window switch assembly of claim 1, further comprising a resilient member, wherein one end of the resilient member is connected to the control member and another end of the resilient member is connected to the first rail body, wherein the resilient member is configured to bias the control member toward a rest position.

6. The window switch assembly of claim 5, wherein the resilient member is configured to be moveable in the first body rail, the first sub-rail and the second sub-rail.

7. The window switch assembly of claim 1, further comprising a second rail body extending at the traverse direction;

a third sub-rail communicating with the second rail body, extending from the second rail body along the longitudinal direction and having two ends spaced apart from the second rail body at the longitudinal direction, a fourth sub-rail communicating with the second rail body, extending from the second rail body along the longitudinal direction and having two ends spaced apart from the second rail body at the longitudinal direction, a middle rail extending along the longitudinal direction and communicating with the first rail body and the second rail body, a fifth switch and a sixth switch disposed at the two ends of the third sub-rail, respectively, a seventh switch and an eighth switch disposed at the two ends of the fourth sub-rail, respectively, wherein the control member selectively contacts the fifth switch and the sixth switch to control a third window, and selectively contacts the seventh switch and the eighth switch to control a fourth window.

8. The window switch assembly of claim 7, further comprising a resilient member, wherein one end of the resilient member is connected to the control member and another end of the resilient member is connected to the middle rail, wherein the resilient member is configured to bias the control member toward a rest position.

9. The window switch assembly of the claim 8, wherein the resilient member is an electric conductive spring, the first switch is a first contact electrically connected to a window control circuit, wherein the control member includes a first contacting point matching the first contact, and wherein the first contacting point is electrically connected to the electric conductive spring which is electrically connected to the window control circuit.

10. A window switch assembly to control multiple windows of a vehicle, comprising:

a base including:

a first rail, wherein the first rail includes a first rail body extending along a transverse direction of the vehicle, and a first sub-rail and a second sub-rail that extend from the first rail body along a longitudinal direction of the vehicle and communicate with the first rail body, the first sub-rail has two ends spaced apart from the first rail body and the second sub-rail has two ends spaced apart from the first rail body, a second rail, wherein the second rail includes a second rail body extending along the transverse direction, and a third sub-rail and a fourth sub-rail that extend from the second rail body along the longitudinal direction, and communicate with the second rail body, the third sub-rail has two ends spaced apart from the second rail body and the fourth sub-rail has two ends spaced apart from the second rail body, and a middle rail extending along the longitudinal direction and communicating with the first rail body and the second rail body;

a plurality of switches including:

a right front window rolling-up switch and a right front window rolling-down switch disposed at the two ends of the first sub-rail, respectively, a left front window rolling-up switch and a left front window rolling-down switch disposed at the two ends of the second sub-rail, respectively, a right rear window rolling-up switch and a right rear window rolling-down switch disposed at the two ends of the third sub-rail, respectively, a left rear window rolling-up switch and a left rear window rolling-down switch disposed at the two ends of the fourth sub-rail, respectively a control member, wherein the control member is received partially in the middle rail at a rest position and is slidable in the first, second, third and fourth sub-rails and the middle rail to contact the switches selectively.

11. The window switch assembly of claim 10, wherein each of the switches is a power switch, wherein the control member contacts one of the switches in a shorter period to roll up or roll down a corresponding window for a certain distance, and the control member contacts one of the switches for a longer period to close or open a corresponding window fully.

12. The window switch assembly of claim 10, wherein the window switch assembly is disposed on a side of a front door adjacent to a driver.

13. The window switch assembly of claim 10, wherein the window switch assembly is disposed on an instrument panel adjacent to a driver.

14. The window switch assembly of claim 10, wherein a side surface of the control member includes a first recess, and wherein a sidewall of the first, second and middle rails includes a first sliding block to be received in the recess to guide the control member to move in the first, second and middle rails.

15. The window switch assembly of claim 10, wherein a bottom wall of the control member includes a second sliding block, wherein a bottom wall of the first, second, and middle rails include a second recess to receive the second sliding block to guide movement of the control member in the first, second and middle rails.

16. The window switch assembly of claim 10, further comprising a spring, wherein one end of the spring is connected to middle rail and another end of the spring is connected to the control member and wherein the spring applies a restoring force to bias the control member to the middle rail.

17. The window switch assembly of claim 16, wherein the control member includes a control rod, wherein each switch is a contact disposed on a sidewall of the sub-rails and electrically connected to a window control circuit, wherein a surface of the control rod adjacent to a sliding end includes a contacting point matching the contact, and wherein the contacting point is electrically connected to the spring which is further connected to the window control circuit, and wherein the control rod touches the switch to enable a connection with the window control circuit.

18. The window switch assembly of claim 16, wherein the control member includes a control rod, wherein each switch includes a contact disposed on a bottom of the sub-rails and electrically connected to a window control circuit, wherein a sliding end of the control rod includes a contacting point matching the contact, wherein the contacting point is electrically connected to the spring which is further electrically connected to the window control circuit, and wherein the control rod touches the switch to enable a connection with the window control circuit.

19. The window switch assembly of claim 16, wherein the spring is configured to be moveable in the first rail, the second rail and the middle rail.

* * * * *